US005532708A

United States Patent [19]

Krenz et al.

[11] Patent Number: 5,532,708

[45] Date of Patent: Jul. 2, 1996

[54] SINGLE COMPACT DUAL MODE ANTENNA

[75] Inventors: Eric L. Krenz, Crystal Lake; David J. Tammen, Hoffman Estates, both of Ill.

[73] Assignee: Motorola, Inc., Schaumburg, Ill.

[21] Appl. No.: 398,278

[22] Filed: Mar. 3, 1995

[51] Int. Cl.[6] ..... H01Q 9/28

[52] U.S. Cl. ..... 343/795; 343/820; 343/876; 343/821

[58] Field of Search ..... 343/795, 700 MS File, 343/727, 853, 725, 793, 745, 859, 820, 821, 865, 876; H01Q 9/28

[56] References Cited

U.S. PATENT DOCUMENTS

| | | | |
|---|---|---|---|
| 5,206,655 | 4/1993 | Caille | 343/700 MS |
| 5,212,494 | 5/1993 | Hofer | 343/859 |
| 5,313,218 | 5/1994 | Busking | 343/727 |

FOREIGN PATENT DOCUMENTS

| | | | |
|---|---|---|---|
| 1003559 | 1/1977 | Canada | 343/795 |

*Primary Examiner*—Hoanganh Le
*Attorney, Agent, or Firm*—Kevin A. Buford

[57] ABSTRACT

A printed circuit board antenna is provided which includes an electronic switch (38) whereby a single compact radiating structure consisting of a split dipole antenna (10) with associated balun structure (11) may be selectively driven in either of two modes to provide orthogonal polarization and pattern diversity: as a split dipole antenna with a quarter wave balun relying on the split dipole antenna (10) as the radiating element; or as a top-loaded monopole relying on the quarter wave balun structure (11) as the radiating element against a ground plane (12). Orthogonal polarization and pattern diversity are achieved as a result of the mutually perpendicular orientations of the split dipole antenna (10) and its integral balun structure (11).

7 Claims, 5 Drawing Sheets

FIG. 7
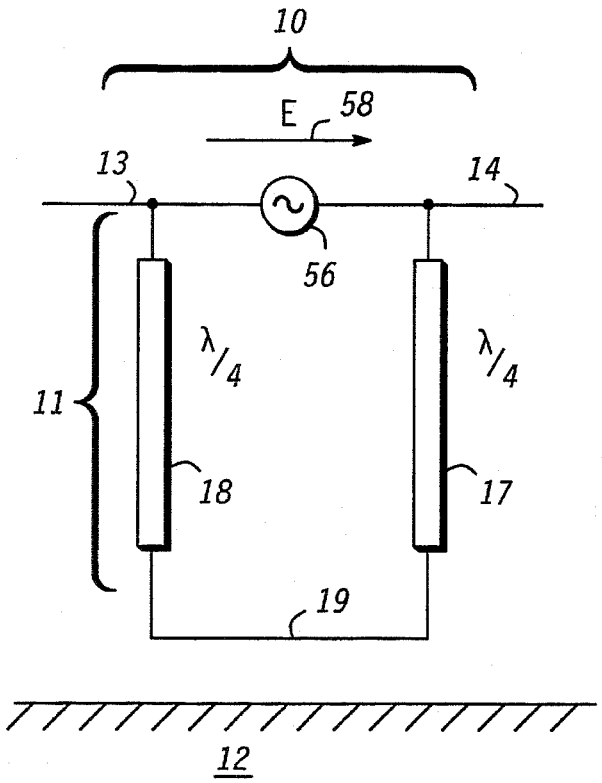
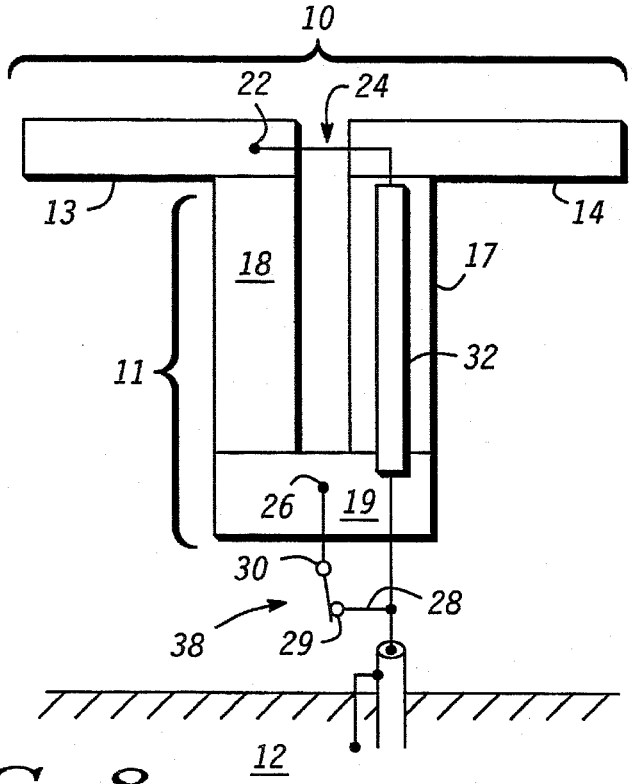
FIG. 8

SINGLE COMPACT DUAL MODE ANTENNA

BACKGROUND OF THE INVENTION

This invention relates, in general to antennas, and in particular, to printed circuit board antennas providing polarization and pattern diversity.

Printed circuit board antennas have been used for many years in military systems and have recently found application in commercial communications, such as wireless Local Area Networks (LANs), in which small physical size is a key requirement. Printed circuit board antennas are elements used for transmission or reception of radio waves in the UHF and microwave/millimeter wave spectra for high frequency communication systems. In these systems the operating wavelengths are sufficiently short to accommodate conveniently small geometries available in planar antenna elements. In wireless LAN applications, an indoor environment is typically encountered wherein the propagation of radio waves from one point to another can be greatly affected by the surrounding structures of office areas, and changes arising from activities taking place within the office area.

Undesired scatter of radio waves from reflective surfaces can promote a condition referred to as multipath interference, which can severely degrade radio signal strength and prevent radio communication from taking place. Solutions to the problem of multipath interference typically make use of the behavior of radio waves and the manner in which antennas respond to them. One solution to improve the response of an antenna to the degradation due to multipath interference is to displace the antenna a distance of approximately one half wavelength from a point in which destructive interference most severely degrades signal intensity. The interference due to multipath can be constructive rather than destructive at such a distance, but this involves physically moving a unit which contains the displaced antenna. Moving the unit containing the antenna is not always feasible if the unit is a desktop computer which is situated in a location that best accommodates a user.

An accompanying solution, which makes use of the concept of locating the antenna in a favorable location, is known as space diversity. This technique utilizes switching between antennas placed in different locations. When propagation conditions in the operating environment change to favor operation with one antenna over another, a switching network is used to select that antenna. This technique makes use of multiple separate antennas spaced apart, but interconnected with switching electronics and cables which take up room, and add cost and complexity to the antenna system. Altering the antenna system characteristics has also been a technique employed to overcome problems caused by multipath interference. One technique which may be used is pattern diversity. Pattern diversity provides an antenna system with alterable electromagnetic field pattern characteristics in any particular plane of its three dimensional far field pattern. This can be accomplished by several means including array phasing or switching from one antenna to another. Either of these methods require more than one antenna radiating element, and generally greater area than a single antenna. The constraints represented by Personal Computer Memory Card International Association (PCMCIA) form factor dimensions render these techniques impractical.

Another technique which has been applied is referred to as polarization diversity. Polarization diversity provides an antenna system with alterable polarization characteristics. This allows the antenna system response to radio waves of different polarizations to be controlled for either maximum or minimum response. This is useful as a solution for multipath interference as well as applications in line of sight (LOS) communications which require the capability of electronically altering antenna system polarization to avoid having to orient the unit containing the antenna, such as a desktop computer, orthogonally so as to correct antenna polarization with respect to that of some access point or base station. Since polarization diversity can be achieved by forcing the field components between two modes of operation to be orthogonal, switching between two antennas which are oriented in a mutually perpendicular fashion has been used. This also makes use of two different antennas, and typically requires greater area than is occupied by a single antenna. The increased area requirement also renders this technique impractical for PCMCIA form factor constraints.

Thus, it would be desirable to provide high speed wireless LAN products with an antenna element which makes use of one or more types of antenna diversity as a means of adaptability to an operational environment where multipath interference is present, and conforms to PCMCIA form factor packaging limitations.

BRIEF DESCRIPTION OF THE DRAWINGS

FIG. 7 is an equivalent circuit schematic of the single compact dual mode antenna in the dipole mode of operation;

FIG. 8 is a functional schematic of the single compact dual mode antenna in the monopole mode of operation.

DETAILED DESCRIPTION OF THE DRAWINGS

It is to be appreciated that the following description applies to the preferred embodiment which makes use of conventional double-sided printed circuit board techniques, or multilayered circuit board techniques comprising a dielectric substrate material or materials with planar structures defined by thin conductive material adhered to either side of the printed circuit board or multilayered board. These structures can be inter-connected with components that are mounted and fastened upon the substrate board on either side, and conductive vias formed through the thickness of the dielectric substrate.

Figure 1:
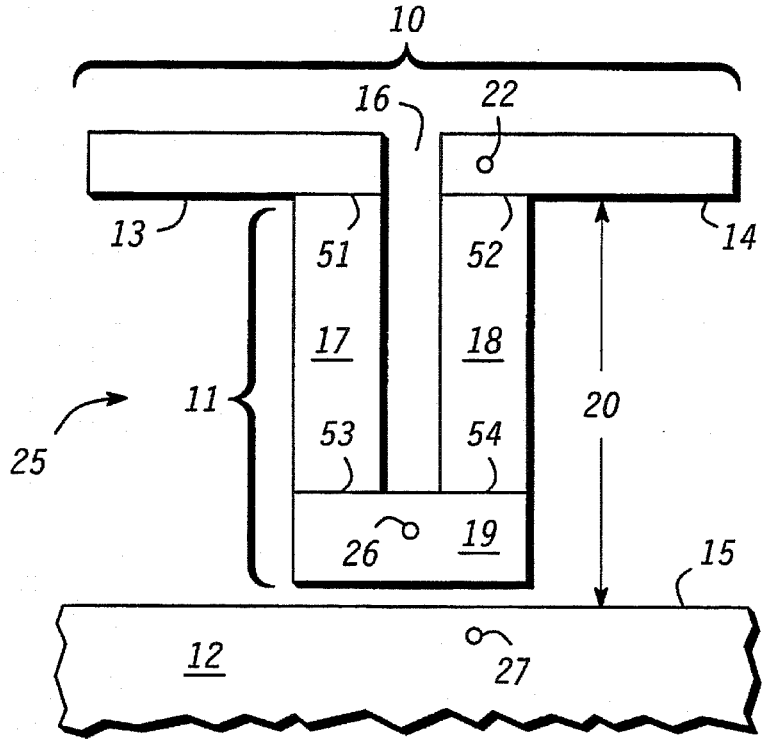
FIG. 1 is a view, of structures on one side of a printed circuit board of a single compact dual mode antenna in accordance with the present invention.

The main structures of a single compact dual mode antenna which are illustrated in FIG. 1 depict a single "T" shaped radiation structure or antenna element 25 in the form of a split dipole antenna 10 with a balun structure 11. FIG. 1 also illustrates a ground plane area 12.

Split dipole antenna 10 is a thin, narrow, planar rectangular conductive strip with a length that is substantially equal to one half wavelength in free space at the desired frequency of operation. The thin, narrow planar rectangular strip has a separation gap 16 in the center of the half wavelength dimension which splits the strip into a pair of equal length split dipole antenna strips 13 and 14. Split dipole strips 13 and 14, one of which provides an RF connection or substrate via connection 22 are aligned end to end with the centers of the lengthwise dimensions aligned. As those skilled in the art will appreciate, width of split dipole antenna strips 13 and 14 is chosen as a compromise between a minimum value such that the conductor losses do not become prohibitive, and a maximum value restricted by mode effects, and packaging limitations.

Alternate embodiments of the split dipole antenna can be substituted for that described in this embodiment, including a folded version in which conductive strips 13 and 14 include right angle corners at the outside ends with extended strips, so as to extend the effective length of the strips without extending the lengthwise dimension occupied by the split dipole antenna 10.

Another version orients conductive strips 13 and 14 at an acute angle, generally 45 degrees, relative to the axis of symmetry of split dipole antenna 10 forming an arrow head shape.

Although the above description applies to a split dipole antenna fabricated using double sided printed circuit board techniques, it is to be appreciated that split dipole antenna 10 described is well known and an alternate embodiment of this invention may include a split dipole antenna formed by other techniques such as with rigid wires formed in the shape of a split dipole antenna.

Balun structure or "U" shaped balun structure 11 is made up of a pair of thin planar rectangular conductive parallel strips 17 and 18 lying in the same plane as split dipole antenna 10. Parallel strips 17 and 18 are parallel in the lengthwise dimension which is substantially equal to one quarter wavelength in free space at the frequency of operation, and width of each strip is equal and substantially less than the length.

The lengthwise dimension of parallel strips 17 and 18 is oriented perpendicularly to the lengthwise dimension of dipole antenna strips 13 and 14, with parallel strips 17 and 18 separated by separation gap 16 which is the same as separation gap 16 between dipole antenna strips 13 and 14. A first pair of adjacent ends 51 and 52 of parallel strips 17 and 18 adjoin with edges of split dipole antenna strips 13 and 14 with the spacing between parallel strips 17 and 18 aligned with separation gap 16. Separation gap 16 of dipole antenna 10 is determined by design of balun structure 11.

A second pair of adjacent ends 53 and 54 of parallel strips 17 and 18 are joined by thin rectangular conductive adjoining strip 19 with a length equal to the sum of the widths of parallel strips 17 and 18 and separation gap 16. The ends of adjoining strip 19 in the width dimension align with the non-adjacent lengthwise edges of parallel strips 17 and 18. Adjoining strip 19, together with parallel strips 17 and 18 form a bight of "U" shaped balun structure 11. Adjoining strip 19 also provides a balun substrate via connection or balun connection 26.

As those skilled in the art will appreciate, widths of parallel strips 17 and 18 are chosen as a compromise between a minimum dimension limited by excessive conductor loss, and coupling characteristics, and a maximum dimension limited by minimum effective impedance and mode effects. The spacing between parallel strips 17 and 18 is a compromise between the effective impedance of the coplanar strip transmission line structure formed by parallel strips 17 and 18, and coupling effects. This spacing establishes the width of gap 16. Parallel strips 17 and 18 essentially form a coplanar strip transmission line which is terminated with a short circuit termination by adjoining strip 19.

It is to be appreciated that balun structure 11 described in the preferred embodiment is well known, and that it can be fabricated by means other than double-sided printed circuit board techniques. An alternate embodiment of balun 11 may be formed of rigid wire conductors in such a "U" shaped balun structure, or by other multilayer planar techniques. It is to be further appreciated that for identification purposes, FIG. 1 shows split dipole antenna 10 and balun structure 11 as distinct parts. Split dipole antenna 10 and balun structure 11 together form a single conductive structure in essentially a "T" shape on one side of a double-sided printed circuit board.

Ground plane area 12 is a thin planar conductive region bounded from a line 15, which is parallel to and spaced a distance 20, substantially a quarter wavelength, away from the lengthwise dimension of split dipole antenna 10. Distance 20 is greater than the total extension of balun structure 11 from split dipole antenna 10. Ground plane area 12 extends either direction along line 15 in and away from dipole antenna 10 as constrained by packaging limitations. Ground plane area 12 has a ground plane substrate via connection 27. It is to be appreciated that ground plane area 12 is electrically connected to system ground in the preferred embodiment.

Figure 2:
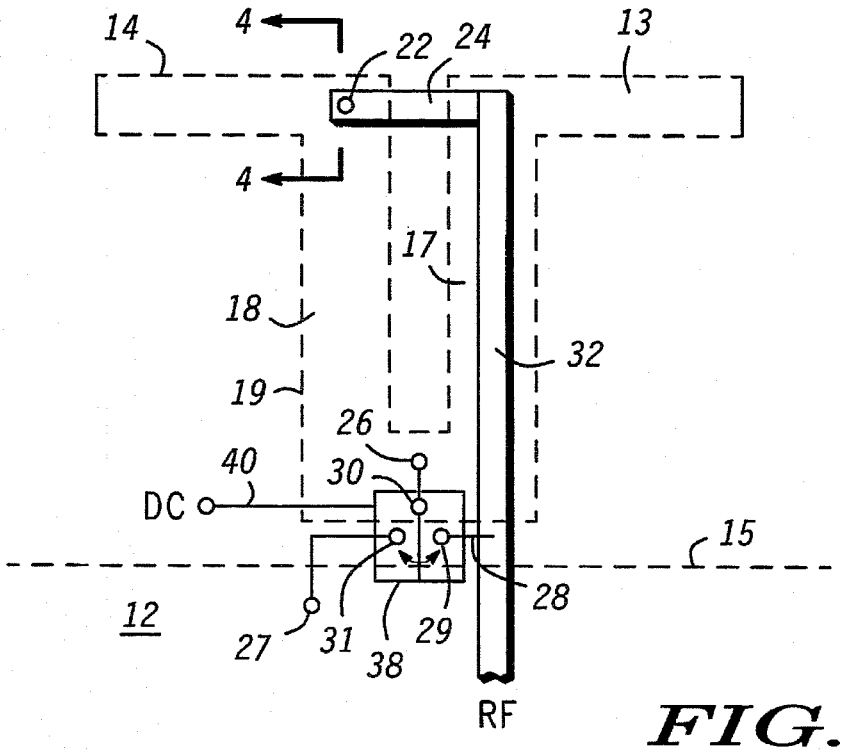
FIG. 2 is a view of structures on the opposite side of the printed circuit board of FIG. 1 in accordance with the present invention.

The main structures illustrated in FIG. 2 are a transmission line antenna feed 32, and an electronic switch 38. In FIG. 2 the structures illustrated in FIG. 1 are represented in dashed lines to provide relative location reference for transmission line antenna feed 32. FIG. 1 and FIG. 2 combined represent a single compact dual mode antenna.

Transmission line antenna feed 32 is a thin planar strip of conductive material located on an opposite side of a double-sided printed circuit board from split dipole antenna 10 and balun structure 11 of FIG. 1. This will become more apparent hereinafter. Transmission line antenna feed 32 is centered over parallel strip 17 of balun structure 11, forming a microstrip transmission line with strip 17 used as a microstrip back plane. Electrical length of transmission line antenna feed 32 is substantially one half wavelength, as defined between a transmission line antenna feed connection 28 and a substrate via connection 22, for the frequency of operation.

The width of transmission line antenna feed 32 is substantially less than the width of balun parallel strip 17 forming its back plane. As those skilled in the art will appreciate, the width of transmission line antenna feed is chosen to provide a desired impedance which in the preferred embodiment of the invention is 50 ohms. The electrical length of transmission line antenna feed 32 is substantially twice that of parallel strip 17 at the frequency of operation, while physical lengths are substantially equal. The effective dielectric constant of a microstrip transmission line such as that formed by transmission line antenna feed 32 and parallel strip 17 depends on the thickness and dielectric constant of dielectric substrate 21 (see FIG. 4) and the width of transmission line antenna feed 32. As those skilled in the art will appreciate, the effective dielectric constant of the microstrip forming transmission line antenna feed 32 accounts for the differences in electrical lengths of transmission line antenna feed 32 and parallel strips 17 and 18.

Transmission line antenna feed 32 provides a thin narrow conductive transmission line antenna feed connection strip 24, which traverses separation gap 16 (see FIG. 1) on an opposite side of a double-sided printed circuit board 35. Transmission line antenna feed connection strip 24 connects one end of transmission line antenna feed 32, extended over split dipole antenna strip 13, to split dipole antenna strip 14 on the opposite side of the printed circuit board by way of substrate via connection 22.

Transmission line antenna feed 32 also provides transmission line antenna feed connection 28 which connects transmission line antenna feed 32 from a location substantially a half wavelength distance from transmission line antenna feed connection strip 24 to a selectable connection 29 provided by an electronic switch 38.

It is to be appreciated that an alternate embodiment of this invention may include a transmission line antenna feed 32 fabricated by means other than double-sided printed circuit board technology such as coaxial cable or other transmission line forms.

Electronic switch 38 is a circuit which provides a low RF impedance at the frequency of operation between a common connection 30 and either of two selectable connections 29 and 31. Selectable connection 29 connects electronic switch 38 and transmission line antenna feed connection 28. Electronic switch 38 electronically connects common connection 30 with a selectable connection 31, selectively grounding balun structure 11 through balun substrate via connection 26.

Either RF energy or ground is connected to balun structure 11 from common connection 30 through balun substrate via connection 26 to adjoining strip 19. DC control bias from one or more external sources supply the appropriate DC levels necessary for altering the electronic switch between two discrete states of operation. Bias is supplied to the electronic switch by one or more DC Bias inputs 40.

Figure 3:
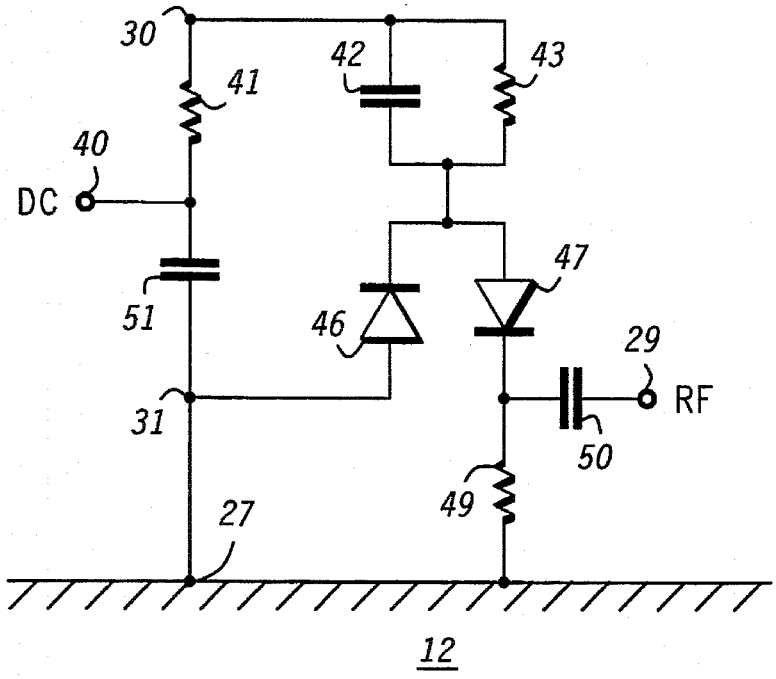
FIG. 3 is an electrical schematic of a single pole double throw electronic switch in accordance with the present invention.

FIG. 3 is an electrical schematic showing detail of circuitry contained in an embodiment of electronic switch 38 of FIG. 2 included in the preferred embodiment of this invention.

In the dipole mode of operation, the bias voltage supplied to DC bias input 40 is −3 V. This forward bias for diode 46 is supplied through current limiting resistors 41 and 43, through diode 46 and selectable connection 31 to ground by ground plane substrate via connection 27. Diode 46 presents a low RF impedance to ground at common connection 30 through coupling capacitor 42, diode 46, and switchable connection 31. The significance of these conditions in the dipole mode of operation will become more apparent hereinafter.

In the monopole mode of operation, the bias voltage supplied to DC bias input 40 is +30 3 V. This forward bias for diode 47 is supplied through current limiting resistors 41 and 43 to diode 47, and through current limiting resistor 49 to ground 12. Diode 47 presents a low RF impedance to the RF signal coupled from switchable connection 29 through DC blocking capacitor 50 through coupling capacitor 42 to common connection 30. The significance of these conditions in the monopole mode of operation will become more apparent hereinafter.

It is to be appreciated that, although diodes 46 and 47 were used as the active switching elements in the preferred embodiment of this invention, it is possible for electronic switch 38 to utilize other types of active elements including bipolar transistors, MESFETs and other commonly used switch components. It is further to be appreciated that the means for switching RF energy or ground to balun 11 is not required to be located in close proximity with the other structures depicted in FIGS. 1 and 2. An alternate embodiment for this invention can also include a single input to balun substrate via connection 26 (FIG. 2) to supply either ground or RF energy of the proper magnitude and phase from a remotely located switch and achieve the requirements for operation of the single compact dual mode antenna.

Figure 4:
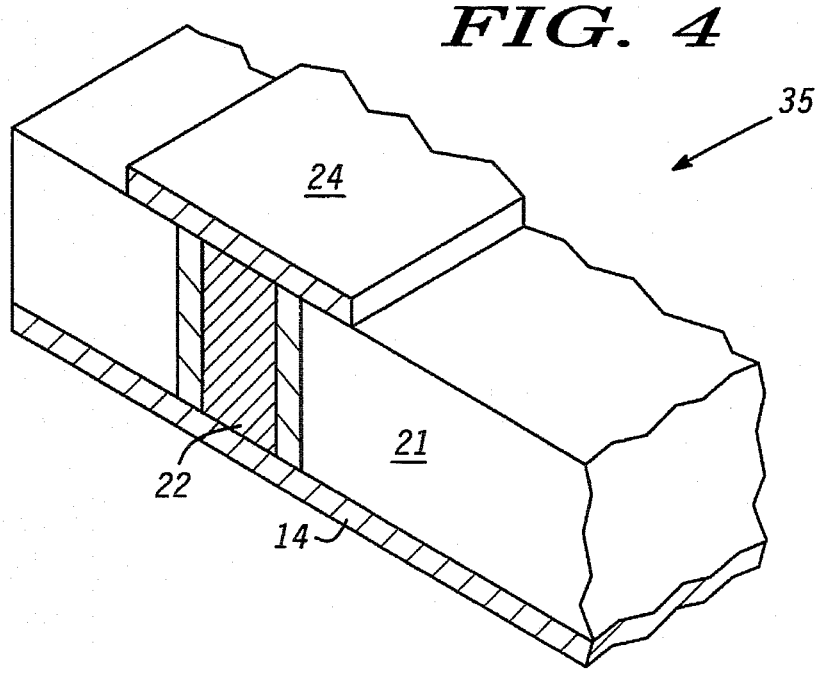
FIG. 4 is a cutaway view along line 4—4 of FIG. 2 of a substrate via interconnect.

FIG. 4 depicts a cut-away view of section 4—4 of FIG. 2 illustrating the manner in which substrate via connection 22 connects transmission line antenna feed connection strip 24 to the structures on opposite side of conventional double-sided printed circuit board 35 through dielectric substrate 21.

Figure 5:
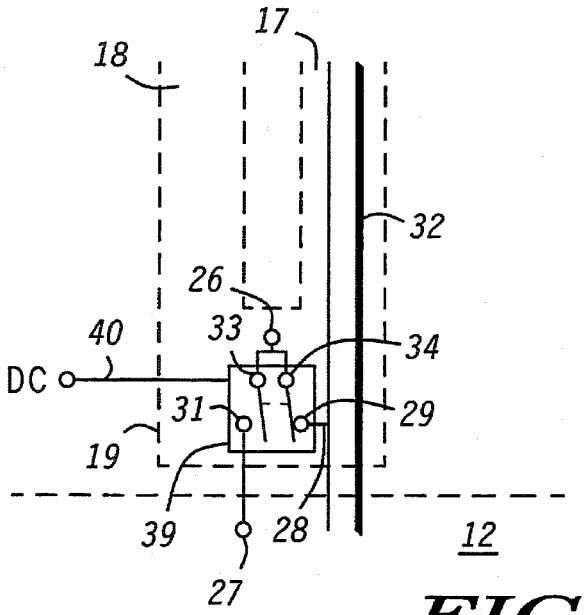
FIG. 5 is a view of an alternate double pole single throw electronic switch in accordance with the present invention.

Although the present embodiment of this invention makes use of one electronic single pole double throw switch 38 shown in FIG. 2, an alternative embodiment may include two electronically gang controlled single pole single throw switches as represented in FIG. 5. Electronic switch 39, which contains two electronically gang controlled single pole single throw switches, depicted in FIG. 5 provides the same selectable connections 29 and 31 as single pole double throw electronic switch 38 shown in FIG. 2, with two pole connections 33 and 34 which require interconnection. Both embodiments of the electronic switch 38 and 39 are comprised of components which may be of printed, discrete packaged, chip or integrated circuit forms or any combination thereof.

Figure 6:
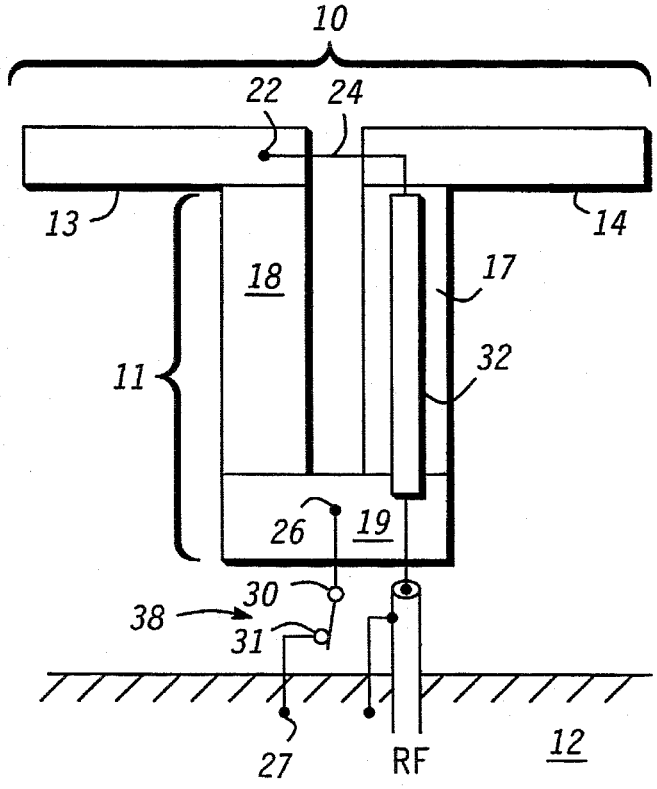
FIG. 6 is a functional schematic of the single compact dual mode antenna in the dipole mode of operation.

FIG. 6 illustrates the functional concept of the single compact dual mode antenna operating in the dipole mode. The following description refers to antenna operation as a transmit antenna, however by reciprocity, a converse description of operation applies for the compact dual mode antenna as a receive antenna. RF drive is supplied from an external source through a transmission line which relies on the same ground reference as the single compact dual mode antenna, as depicted by a coaxial shield on transmission line antenna feed 32 having a connection to ground plane 12. However, the preferred embodiment of the invention uses microstrip with ground plane area 12 for a microstrip back plane. Coaxial transmission line with a shield grounded to ground plane area emphasizes that this transmission line uses ground plane area 12 as its ground reference. RF drive is applied between two split dipole antenna strips 13 and 14 of split dipole antenna 10 through substrate via connection 22. The signal reaches substrate via connection 22 through transmission line antenna feed connection strip 24 from transmission line antenna feed 32. Transmission line antenna feed 32 uses one parallel strip 17 of quarter wave balun structure 11 for the bottom conductor forming a microstrip transmission line. Common connection 30 of electronic switch 38 electronically selects ground through selectable connection 31 thereby providing uninterrupted ground to balun structure 11. This selectably connects ground plane 12 with adjoining strip 19 which grounds balun structure 11. Parallel strip 17 forms the bottom conductor for transmission line antenna feed 32. Parallel strips 17 and 18 of balun structure 11 form a balanced coplanar strip transmission line with one pair of ends short circuited together and grounded through the electronic switch 38. The other ends of parallel strips 17 and 18 are connected to split dipole antenna 10. The quarter wavelength dimension of the balanced coplanar strip transmission line formed by parallel strips 17 and 18 transforms the impedance of the grounded ends to an open circuit impedance at substrate via connection 22. This results in an open circuit impedance on split dipole antenna 10 at substrate via connection 22 due to the presence of a short circuit impedance on the shorted end of the balanced coplanar strip transmission line. This results in minimal loading effects on split dipole antenna 10 due to transmission line antenna feed connection strip 24.

FIG. 7 illustrates the equivalent circuit for the single compact dual mode antenna operating in the dipole mode. As can be seen from the illustration of the equivalent circuit, the quarter wavelength balun structure 11 effectively transforms the unbalanced microstrip medium of transmission line antenna feed 32 into a balanced excitation source 56 required for feeding split dipole antenna 10. Source 56 drives split dipole antenna 10 between split dipole antenna strips 13 and 14 resulting in an E-field polarization as depicted by an arrow 58 shown relative to split dipole antenna 10 and balun structure 11.

FIG. 8 illustrates the functional concept of the single compact dual mode antenna operating in the monopole mode of operation. RF drive is supplied from an external source through a transmission line which relies on the same ground reference as the single compact dual mode antenna, as depicted by the coaxial shield connection to ground plane 12. The preferred embodiment of the invention uses microstrip with ground plane area 12 for a microstrip back plane. A coaxial transmission line with a shield grounded to ground plane area emphasizes that this transmission line uses ground plane area 12 as its ground reference. RF drive is applied between balun structure 11 and ground plane area 12 through common connection 30 of electronic switch 38 with selectable connection 29. This arrangement connects transmission line antenna feed connection 28 with balun structure 11. This provides monopole excitation of balun structure 11 against ground plane 12 to cause balun structure 11 to behave as a monopole antenna with ground plane area 12 providing image response for the balun structure in the monopole mode of operation. The short circuit impedance of electronic switch 38 connections of selectable connection 29 and common connection 30 are transformed through a half wavelength by transmission line antenna feed 32 presenting a short circuit impedance at substrate via connection point 22.

In the preferred embodiment of the invention, The phase of the RF energy connected to balun connection 26 leads the RF energy connected to RF connection 22, provided by split dipole antenna 10, by a phase commensurate with one half wavelength. This suppresses excitation of the dipole mode of radiation by forcing equal potentials to exist at the ends of parallel strips 17 and 18 which connect balun structure or monopole antenna 11 to split dipole antenna 10. In this mode of excitation, split dipole antenna 10 acts as a large top load for the monopole formed by balun structure 11 excited against ground plane area 12.

Figure 9:
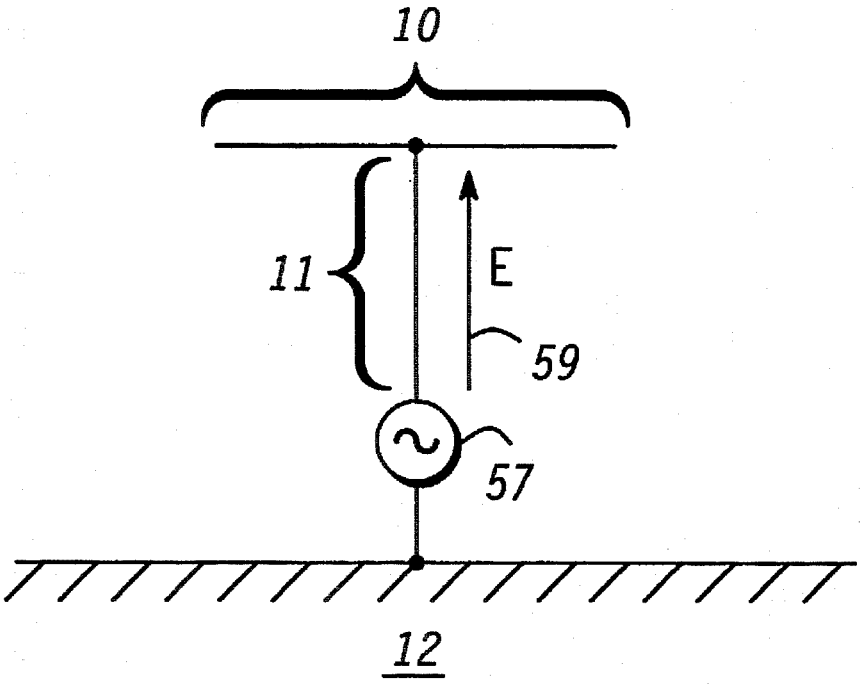
FIG. 9 is an equivalent circuit schematic of the single compact dual mode antenna in the monopole mode of operation.

FIG. 9 illustrates the equivalent circuit of the single compact dual mode antenna in the monopole mode of operation. Balun structure 11 is represented as a single antenna element because of the equal potentials forced at the ends connecting with split dipole antenna 10, represented as a top load. Source 57 drives balun 11 resulting in an E-field polarization, represented by arrow 59, relative to split dipole antenna or load 10 acting as a top load and balun structure 11 acting as the radiating element in the monopole mode. It is to be appreciated that the arrow 58 depicting E-field polarization in the dipole mode of operation in FIG. 7 is orthogonal to the E-field polarization arrow 59 in the monopole mode of operation depicted in FIG. 8. It is further to be appreciated that the directions of electrical currents in split dipole antenna strips 13 and 14 are directed from their ends connected to balun structure 11 outward to their open ends. As those skilled in the art will appreciate, the far field effects of these opposing currents substantially cancel, thus leaving the antenna pattern of the monopole mode unaffected.

By now, it can be appreciated that the single compact dual mode antenna provides electronically switched orthogonal polarizations. As those skilled in the art will appreciate, the far field antenna radiation pattern in the dipole mode of operation forms nulls at both open ends of antenna dipole strips 13 and 14. Those skilled in the art will also appreciate that in the monopole mode of operation, the far field antenna radiation pattern forms nulls at the separation gap 16, between dipole antenna strips 13 and 14, and its image in ground plane area 12. These differences in the far field antenna radiation patterns, as the result of switching modes of operation, provide pattern diversity. The single compact dual mode antenna accomplishes both orthogonal polarization and pattern diversity using a single "T" shaped radiation structure made up of two mutually perpendicular integral parts and electronically switched connections. The single "T" shaped radiation structure, comprised of split dipole antenna 10 and its integral balun structure 11 results in the fewest number of radiating elements necessary to achieve orthogonal antenna polarization and pattern diversity. This invention provides the simplest design of a compact, radiation diverse antenna which conforms to PCMCIA form factor packaging limitations.

We claim:

1. A single compact dual mode antenna, fabricated using double-sided printed circuit board techniques or multilayered circuit board techniques to form a single "T" shaped radiation structure providing electronically switched orthogonal polarizations and pattern diversity as in a dipole mode of operation and in a monopole mode of operation comprising:

an antenna element having a half wavelength dimension used as a split dipole antenna in a dipole mode of operation, and as a load in a monopole mode of operation;

a balun structure which is integral to, and situated coplanarly with and orthogonally to, the antenna element, used as a balun structure for the antenna element in the dipole mode of operation and as a monopole antenna in the monopole mode of operation;

a ground plane area which selectably connects to the balun structure in the dipole mode of operation and provides image response for the balun structure in the monopole mode of operation;

a transmission line antenna feed situated on an opposite side of a conventional double-sided printed circuit board which provides connection to or from the antenna element in both the dipole and monopole modes of operation, and selectably provides connection to the balun structure in the monopole mode of operation; and an electronic switch which electronically selects ground from the ground plane area to the balun structure in the dipole mode of operation, or connects the transmission line antenna feed to the balun structure in the monopole mode of operation.

2. The single compact dual mode antenna of claim 1 wherein the antenna element is comprised of narrow, rectangular quarter wavelength conductive strips forming a split dipole antenna, one strip of the split dipole antenna providing connection with a transmission line antenna feed connection strip.

3. The single compact dual mode antenna of claim 1 wherein the balun structure is comprised of a pair of thin planar rectangular conductive parallel strips with a first pair of adjacent ends connected with the antenna element, and a second pair of adjacent ends connected together with a thin rectangular conductive adjoining strip with a balun substrate via connection to which either ground is connected.

4. The single compact dual mode antenna of claim 1 wherein the ground plane area is comprised of a thin planar conductive region defined by a line parallel to a half wavelength dimension of the antenna element extending in either direction and away from the antenna element as constrained by packaging limitations, and a ground plane substrate via connection which connects to a selectable connection of the electronic switch.

5. The single compact dual mode antenna of claim 1 wherein the transmission line antenna feed, located on an opposite side of the double-sided printed circuit board from the antenna element, is comprised of a thin, narrow, one half wavelength conductive strip centered over one conductive parallel strip of the balun structure on the opposite side of the conventional double-sided printed circuit board so as to form a microstrip transmission line.

6. The single compact dual mode antenna of claim 5 wherein the transmission line antenna feed further includes a narrow, conductive transmission line antenna feed connection strip connecting one end of the transmission line antenna feed to a substrate via connection provided by the antenna element, and a transmission line antenna feed connection provided by the transmission line antenna feed substantially a half wavelength from an end connected to the narrow, conductive transmission line antenna feed connection strip.

7. The single compact dual mode antenna of claim 1 wherein, the electronic switch includes a common connection which connects to a balun substrate via connection, a selectable connection which connects with a ground plane substrate via connection which grounds the balun structure in the dipole mode of operation, and a selectable connection which connects with the transmission line antenna feed in the monopole mode of operation.

* * * * *